US008240840B2

(12) United States Patent
Usuda et al.

(10) Patent No.: US 8,240,840 B2
(45) Date of Patent: Aug. 14, 2012

(54) LIQUID EJECTING APPARATUS AND LIQUID EJECTING METHOD

(75) Inventors: Hidenori Usuda, Matsumoto (JP); Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 453 days.

(21) Appl. No.: 12/490,536

(22) Filed: Jun. 24, 2009

(65) Prior Publication Data

US 2009/0322820 A1 Dec. 31, 2009

(30) Foreign Application Priority Data

Jun. 25, 2008 (JP) ..... 2008-166314

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS 7,066,567 B2 * 6/2006 Nishino ..... 347/17
7,374,280 B2 * 5/2008 Kusunoki ..... 347/102
7,407,277 B2 * 8/2008 Yoneyama ..... 347/102
7,497,553 B2 * 3/2009 Hoshino ..... 347/41
2004/0114016 A1 * 6/2004 Yokoyama ..... 347/102
2004/0114017 A1 * 6/2004 Yokoyama ..... 347/102
2005/0062830 A1 * 3/2005 Taki et al. ..... 347/130
2006/0066703 A1 * 3/2006 Kadomatsu et al. ..... 347/102

FOREIGN PATENT DOCUMENTS

JP 2004-202864 7/2004

* cited by examiner

*Primary Examiner* — Matthew Luu
*Assistant Examiner* — Renee I Wilson
(74) *Attorney, Agent, or Firm* — Workman Nydegger

(57) ABSTRACT

A liquid ejecting apparatus includes an array of nozzles and a light-emitting portion that emits ultraviolet light. A control portion alternately and repetitively transports a medium in a transporting direction relative to the nozzles. The control portion forms a dot group in the transporting direction on the medium by ejecting a liquid toward the medium from the nozzles. The control portion also performs a light-emitting operation every time the control portion forms a dot group. The light-emitting operation is performed by causing the light-emitting portion to emit the ultraviolet light toward the dot group to cure the dot group. During the light-emitting operation, at least one of two ends of the dot group in the transporting direction is exposed to the ultraviolet light at a time later than the time at which a midsection of the dot group in the transporting direction is exposed to the ultraviolet light.

7 Claims, 11 Drawing Sheets

LIQUID EJECTING APPARATUS AND LIQUID EJECTING METHOD

CROSS-REFERENCE TO RELATED APPLICATION

The entire disclosure of Japanese Patent Application No. 2008-166314, filed Jun. 25, 2008 is expressly incorporated by reference herein.

BACKGROUND

1. Technical Field

The present invention relates to liquid ejecting apparatuses and liquid ejecting methods. In particular, the invention relates to a liquid ejecting apparatus and a liquid ejecting method for ejecting a liquid onto a medium and emitting ultraviolet light toward dots formed on the medium to cure the dots.

2. Related Art

A known liquid ejecting apparatus includes a plurality of nozzles arranged in an array, a light-emitting portion that emits ultraviolet light, and a control portion (for example, see JP-A-2004-202864). In such a liquid ejecting apparatus, the control portion alternately and repetitively performs a transporting operation of transporting a medium in a transporting direction relative to the nozzles and a dot-group formation operation of forming a dot group in the transporting direction on the medium by ejecting a liquid toward the medium from the nozzles so as to form the dot group in a plurality in the transporting direction. In addition, the control portion also performs a light-emitting operation every time it performs the dot-group formation operation. Specifically, the light-emitting operation is performed by causing the light-emitting portion to emit the ultraviolet light toward each dot group to cure the dot group.

In the medium on which the dot groups are formed, the thickness of the liquid landed on the medium (specifically, the thickness of the liquid landed and cured on the medium, which will simply be referred to as "thickness" hereinafter) is preferably uniform in the transporting direction. When forming a plurality of dot groups in the transporting direction, the dot groups can sometimes partly overlap each other. In that case, the overlapping regions of the dot groups become thicker than the remaining regions of the medium. Moreover, an end of a dot group in the transporting direction tends to become overlapped by a larger number of dot groups (specifically, dot groups formed in different dot-group formation operations), as compared with the midsection of the dot group. In other words, the end of the dot group tends to become thicker than the midsection of the dot group. This can result in a non-uniform thickness.

SUMMARY

An advantage of some aspects of the invention is that the thickness of a liquid landed on a medium can be made uniform.

According to an aspect of the invention, a liquid ejecting apparatus includes a plurality of nozzles arranged in an array, a light-emitting portion that emits ultraviolet light, and a control portion that alternately and repetitively performs a transporting operation of transporting a medium in a transporting direction relative to the nozzles and a dot-group formation operation of forming a dot group in the transporting direction on the medium by ejecting a liquid toward the medium from the nozzles so as to form the dot group in a plurality in the transporting direction, and that also performs a light-emitting operation every time the control portion performs the dot-group formation operation. The light-emitting operation is performed by causing the light-emitting portion to emit the ultraviolet light toward each dot group to cure the dot group. During the light-emitting operation, at least one of two ends of the dot group in the transporting direction is exposed to the ultraviolet light emitted from the light-emitting portion at a timing later than a timing at which a midsection of the dot group in the transporting direction is exposed to the ultraviolet light emitted from the light-emitting portion.

Other features of the invention will be clarified by this specification and the attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
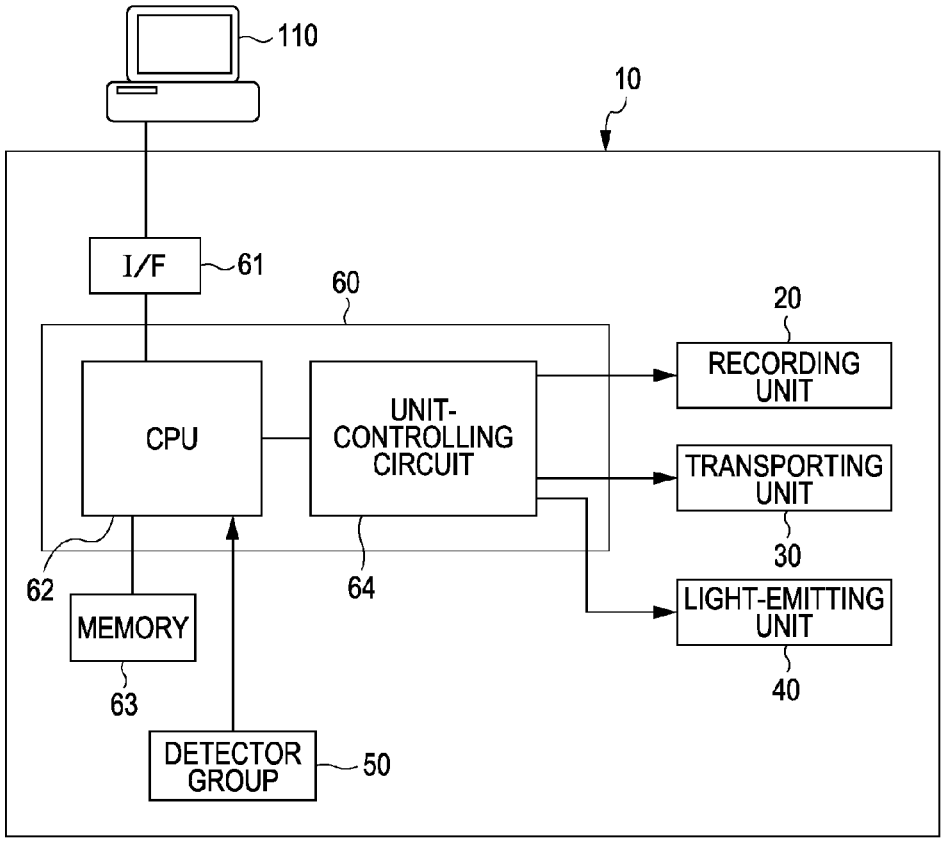
FIG. 1 is a block diagram illustrating a configuration of a printer 10.

The following is at least clarified by this specification and the attached drawings.

A liquid ejecting apparatus includes a plurality of nozzles arranged in an array, a light-emitting portion that emits ultraviolet light, and a control portion that alternately and repetitively performs a transporting operation of transporting a medium in a transporting direction relative to the nozzles and a dot-group formation operation of forming a dot group in the transporting direction on the medium by ejecting a liquid toward the medium from the nozzles so as to form the dot group in a plurality in the transporting direction, and that also performs a light-emitting operation every time the control portion performs the dot-group formation operation. The light-emitting operation is performed by causing the light-emitting portion to emit the ultraviolet light toward each dot group to cure the dot group. During the light-emitting operation, at least one of two ends of the dot group in the transporting direction is exposed to the ultraviolet light emitted from the light-emitting portion at a timing later than a timing at which a midsection of the dot group in the transporting direction is exposed to the ultraviolet light emitted from the light-emitting portion.

According to this liquid ejecting apparatus, the curing time of dots (i.e., the time that takes the dots to be cured after they are formed) is longer at the at least one end of the dot group than at the midsection of the dot group. In other words, the dot located at the at least one end is wetted and spread out before it is cured so as to have a thickness smaller than that of the dots located in the midsection. In consequence, the ends (i.e., the at least one end) of the dot group, which tend to become thicker by being overlapped by a larger number of dot groups formed in different dot-group formation operations, and the midsection of the dot group can substantially have the same thickness. In other words, the thickness of the liquid landed on the medium can be made uniform.

In the aforementioned liquid ejecting apparatus, the light-emitting portion may include an ultraviolet light source that emits the ultraviolet light towards the dot group while facing the dot group. In this case, during the light-emitting operation, the light source may face the at least one end of the dot group at a timing later than a timing at which the light source faces the midsection of the dot group. According to this configuration, the at least one end of the dot group can be readily exposed to the ultraviolet light emitted from the light-emitting portion at a timing later than a timing at which the midsection of the dot group is exposed to the ultraviolet light emitted from the light-emitting portion.

In the aforementioned liquid ejecting apparatus, it is preferable that, when performing the dot-group formation operation, the control portion cause the nozzles to eject the liquid towards the medium while moving the nozzles in a crosswise direction extending crosswise to the transporting direction. In this case, the light source may follow the nozzles in the crosswise direction when the nozzles move in the crosswise direction. Moreover, a section of the light source that faces the at least one end of the dot group may be located opposite the nozzles, in the crosswise direction, relative to a section of the light source that faces the midsection of the dot group. According to this configuration, the at least one end of the dot group can be readily exposed to the ultraviolet light emitted from the light-emitting portion at a timing later than a timing at which the midsection of the dot group is exposed to the ultraviolet light emitted from the light-emitting portion.

In the aforementioned liquid ejecting apparatus, a section of the light source that faces one end of the dot group and a section of the light source that faces another end of the dot group may both be located opposite the nozzles, in the crosswise direction, relative to the section of the light source that faces the midsection of the dot group. According to this configuration, the thickness of the liquid landed on the medium can be made uniform in the transporting direction.

As an alternative to the aforementioned liquid ejecting apparatus, there can be provided a liquid ejecting apparatus that includes a plurality of nozzles arranged in an array, a light-emitting portion that emits ultraviolet light, and a control portion that alternately and repetitively performs a transporting operation of transporting a medium in a transporting direction relative to the nozzles and a dot-group formation operation of forming a dot group in the transporting direction on the medium by ejecting a liquid toward the medium from the nozzles so as to form the dot group in a plurality in the transporting direction, and that also performs a light-emitting operation every time the control portion performs the dot-group formation operation. The light-emitting operation is performed by causing the light-emitting portion to emit the ultraviolet light toward each dot group to cure the dot group. During the light-emitting operation, an emission intensity of the ultraviolet light emitted from the light-emitting portion towards at least one of two ends of the dot group in the transporting direction is lower than an emission intensity of the ultraviolet light emitted from the light-emitting portion towards a midsection of the dot group in the transporting direction. Similar to the aforementioned liquid ejecting apparatus, this liquid ejecting apparatus allows for a uniform thickness of the liquid landed on the medium.

Furthermore, there is provided a liquid ejecting method that includes alternately and repetitively performing a transporting operation of transporting a medium in a transporting direction relative to a plurality of nozzles and a dot-group formation operation of forming a dot group in the transporting direction on the medium by ejecting a liquid toward the medium from the nozzles so as to form the dot group in a plurality in the transporting direction, and performing a light-emitting operation of emitting the ultraviolet light toward each dot group every time the dot-group formation operation is performed. During the light-emitting operation, at least one of two ends of the dot group in the transporting direction is exposed to the ultraviolet light at a timing later than a timing at which a midsection of the dot group in the transporting direction is exposed to the ultraviolet light.

Alternatively, there can be provided a liquid ejecting method that includes alternately and repetitively performing a transporting operation of transporting a medium in a transporting direction relative to a plurality of nozzles and a dot-group formation operation of forming a dot group in the transporting direction on the medium by ejecting a liquid toward the medium from the nozzles so as to form the dot group in a plurality in the transporting direction, and performing a light-emitting operation of emitting the ultraviolet light toward each dot group every time the dot-group formation operation is performed. During the light-emitting operation, an emission intensity of the ultraviolet light emitted towards at least one of two ends of the dot group in the transporting direction is lower than an emission intensity of the ultraviolet light emitted towards a midsection of the dot group in the transporting direction.

According to these liquid ejecting methods, the thickness of the liquid landed on the medium can be made uniform.

Liquid Ejecting Apparatus According to an Embodiment

Figure 2A:
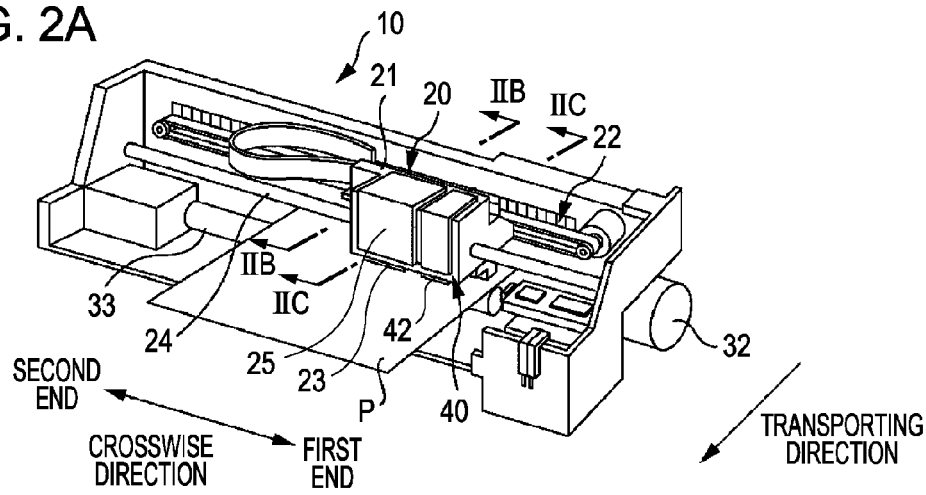
FIGS. 2A to 2C illustrate a basic structure of the printer 10.
Figure 2B:
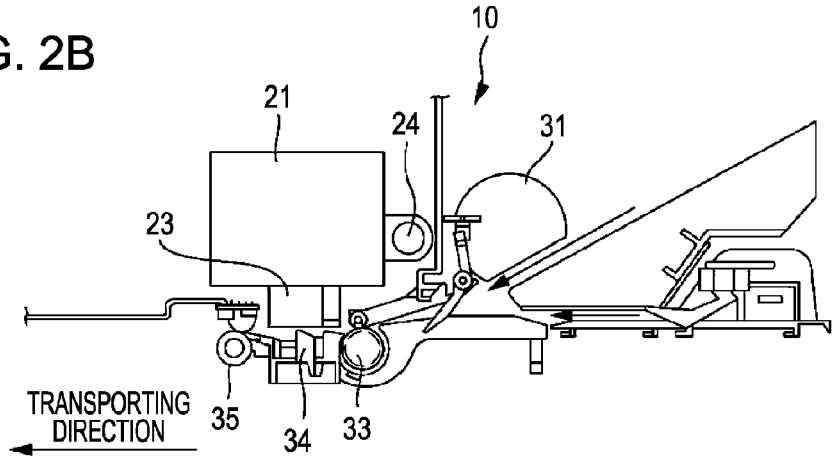
Figure 2C:
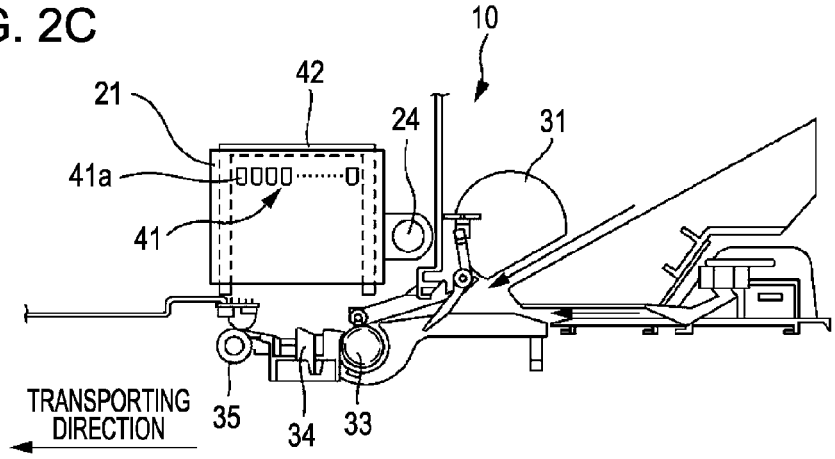
Figure 3:
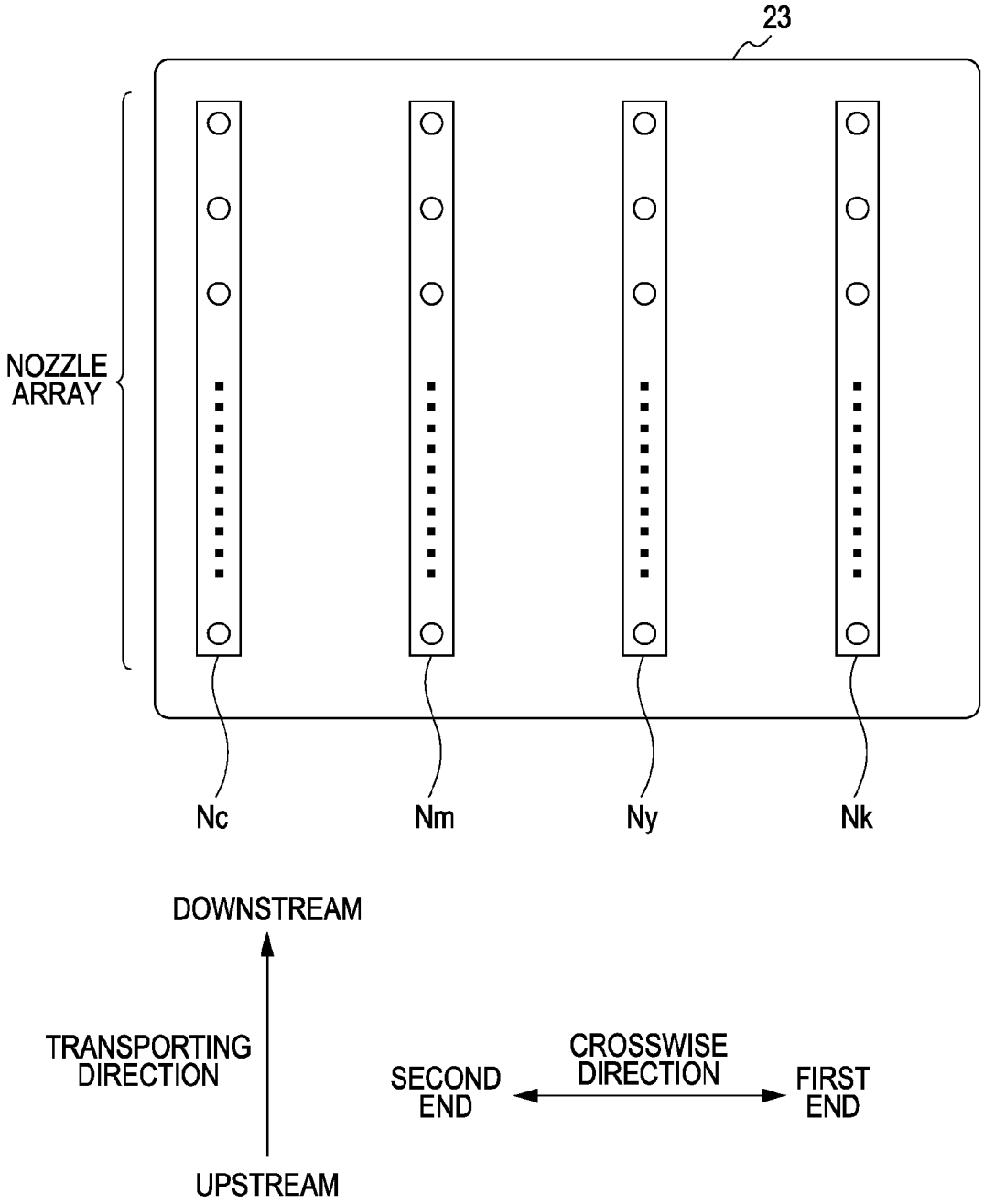
FIG. 3 illustrates nozzle arrays.

An inkjet printer (referred to as "printer 10" hereinafter) as an example of a liquid ejecting apparatus according to an embodiment of the invention will be described below with reference to FIG. 1, FIGS. 2A to 2C, and FIG. 3. FIG. 1 is a block diagram illustrating a configuration of the printer 10. FIGS. 2A to 2C illustrate a basic structure of the printer 10. Specifically, FIG. 2A schematically illustrates an overall structure of the printer 10. FIG. 2B is a cross-sectional view taken along line IIB-IIB in FIG. 2A. FIG. 2C is a cross-sectional view taken along line IIC-IIC in FIG. 2A. In FIG. 2A, a transporting direction of a medium P and a crosswise direction extending crosswise to the transporting direction are indicated by respective arrows. In FIGS. 2B and 2C, the transporting direction is indicated by an arrow. FIG. 3 illustrates nozzle arrays. In FIG. 3, the transporting direction and the crosswise direction are indicated by respective arrows.

The printer 10 according to this embodiment is configured to print an image on the medium P, such as paper, cloth, or a film sheet, by ejecting ultraviolet curable ink (referred to as "UV ink" hereinafter), which is an example of a liquid, toward the medium P. The UV ink is prepared by adding an adjuvant, such as an antifoaming agent, to a mixture of a vehicle containing ultraviolet curable resin, a photopolymerization initiator, and a pigment. When the UV ink receives ultraviolet light, a photopolymerization reaction occurs in the ultraviolet curable resin, thereby causing the UV ink to be cured. The printer 10 according to this embodiment is configured to print a color image by using UV inks of four colors, i.e., cyan, magenta, yellow, and black (CMYK).

Referring to FIG. 1, the printer 10 includes a recording unit 20, a transporting unit 30, a light-emitting unit 40 as an example of a light-emitting portion, a detector group 50, and a controller 60 as an example of a control portion. When the printer 10 receives print data from a computer 110, the controller 60 controls the individual units (namely, the recording unit 20, the transporting unit 30, and the light-emitting unit 40) on the basis of the print data so that an image according to the print data is printed on the medium P. The detector group 50 detects the condition in the printer 10 and outputs a signal according to the detection result to the controller 60.

The recording unit 20 is configured to record an image on the medium P. Referring to FIGS. 2A and 2B, the recording unit 20 includes a carriage 21, a carriage moving mechanism 22, and a head 23. While being supported by a guide shaft 24 extending crosswise to the transporting direction, the carriage 21 is reciprocated along the guide shaft 24 by the carriage moving mechanism 22. In this embodiment, the traveling direction of the carriage 21, that is, the axial direction of the guide shaft 24, corresponds to the crosswise direction.

The head 23 has a plurality of nozzles on an undersurface (referred to as "nozzle face" hereinafter) thereof. The head 23 is configured to eject UV ink supplied from an ink cartridge 25 mounted on the carriage 21 towards the medium P through the nozzles. Referring to FIG. 3, the head 23 has a plurality of nozzles for each of ink colors CMYK. Specifically, the nozzles for each ink color are arranged at an equal nozzle pitch in a direction crosswise to the traveling direction of the carriage 21 so as to form a nozzle array. In other words, nozzle arrays Nc, Nm, Ny, and Nk for the four respective colors CMYK are formed on the nozzle face. Each nozzle is provided with an ink chamber (not shown) and a piezo element (not shown). By driving the piezo element, the ink chamber is contracted and expanded, causing a UV ink droplet to be ejected from the nozzle. While being positioned above the medium P, the head 23 ejects UV ink droplets toward the medium P from the nozzles. The ejected UV ink droplets each land on the medium P so as to form a dot. Specifically, when UV ink droplets are ejected from the respective nozzles in each nozzle array, a dot group constituted by a plurality of dots is formed on the medium P. The dots in this dot group are arranged parallel to the direction in which the nozzles in each nozzle array are arranged.

The head 23 is mounted on the carriage 21 such that, when the carriage 21 moves, the head 23 moves together with the carriage 21 in the same direction as the traveling direction of the carriage 21. While moving together with the carriage 21, the head 23 intermittently ejects UV ink droplets from the nozzles in the individual nozzle arrays. As a result, dot groups arranged at fixed intervals in the traveling direction of the carriage 21, i.e., the crosswise direction, are formed one after another on the medium P. In other words, a plurality of dot rows (raster lines) extending in the crosswise direction are formed so as to be arranged in the transporting direction. In this embodiment, the head 23 is configured to eject ink while moving from a first end to a second end in the crosswise direction, but is configured not to eject ink when moving from the second end to the first end.

The transporting unit 30 is configured to transport the medium P in the transporting direction, as shown in FIGS. 2A to 2C. In other words, the transporting unit 30 is provided for moving the medium P relative to the nozzles. The term "transporting direction" refers to a direction parallel to the direction in which the nozzles constituting each of the nozzle arrays Nc, Nm, Ny, and Nk are arranged. As shown in FIGS. 2A and 2B, the transporting unit 30 includes a feeding roller 31, a transporting motor 32, a transporting roller 33, a platen 34, and a discharging roller 35. When the medium P inserted into an insertion slot is fed into the printer 10 by the feeding roller 31, the transporting roller 33 rotating in response to rotation of the transporting motor 32 transports the medium P in the transporting direction to a printable area. Subsequently, the medium P is transported in a stepwise manner by a predetermined distance while being supported by the platen 34, and is finally discharged outward from the printer 10 by the discharging roller 35.

The light-emitting unit 40 is configured to emit ultraviolet light toward the dot groups formed on the medium P. The dot groups exposed to the ultraviolet light emitted from the light-emitting unit 40 become cured and fixed to the medium P. As shown in FIG. 2C, the light-emitting unit 40 includes an ultraviolet light source 41 and an accommodation box 42 that accommodates the light source 41 therein. The light source 41 is isolated from the head 23 by being accommodated inside the accommodation box 42. Thus, the ultraviolet light from the light source 41 is prevented from leaking to the nozzle face, thereby preventing nozzle clogging that can occur when the UV ink is cured near the openings of the nozzles on the nozzle face.

Since the accommodation box 42 is a bottomless box, the light source 41 is exposed to the outside and is viewable from under the light-emitting unit 40. Thus, the light source 41 is made to face the medium P when the medium P is positioned below the light source 41. In a state where the light source 41 faces the dot groups formed on the medium P, the light-emitting unit 40 emits ultraviolet light towards the dot groups from the light source 41. The light source 41 in this embodiment is of a type constituted by a plurality of UV-light-emitting elements 41*a*, but may alternatively be a metal halide lamp, a xenon lamp, a carbon-arc lamp, a chemical lamp, a low-pressure mercury lamp, or a high-pressure mercury lamp. The light source 41 will be described in detail later.

As shown in FIG. 2A, in this embodiment, the light-emitting unit 40 is mounted on the carriage 21 together with the head 23 and is disposed adjacent to the first end of the head 23 in the crosswise direction. Thus, when the carriage 21 moves, the head 23 and the light-emitting unit 40 move together in the crosswise direction. In other words, when the nozzle arrays for the respective ink colors move from the first end to the second end in the crosswise direction, the light source 41 follows the nozzle arrays while maintaining its position relative to these nozzle arrays.

While the carriage 21 moves from the first end to the second end in the crosswise direction, UV ink droplets are ejected from the nozzle arrays for the respective ink colors, so that dot groups are sequentially formed from the first end. In addition, the light source 41 that follows the nozzle arrays sequentially faces the dot groups from the first end. Specifically, in the carriage 21 moving from the first end towards the second end in the crosswise direction, the nozzle arrays for the respective ink colors located closer to the second end (i.e., the leading end) of the carriage 21 eject UV ink droplets while the light source 41 of the light-emitting unit 40 located closer to the first end (i.e., the trailing end) of the carriage 21 emits ultraviolet light towards the dot groups (specifically, a dot group positioned directly below the light-emitting unit 40).

The controller 60 includes a central processing unit (CPU) 62 used for controlling the individual units in the printer 10 via a unit-controlling circuit 64. Specifically, the controller 60 is configured to perform a dot-group formation operation of forming dot groups on the medium P by ejecting UV ink droplets thereon from the nozzles (i.e., the nozzle arrays for the respective ink colors) in the head 23 while moving the carriage 21, a transporting operation by using the transporting unit 30, and a light-emitting operation by causing the light source 41 of the light-emitting unit 40 to emit ultraviolet light toward the dot groups.

Light Source 41

Figure 4:
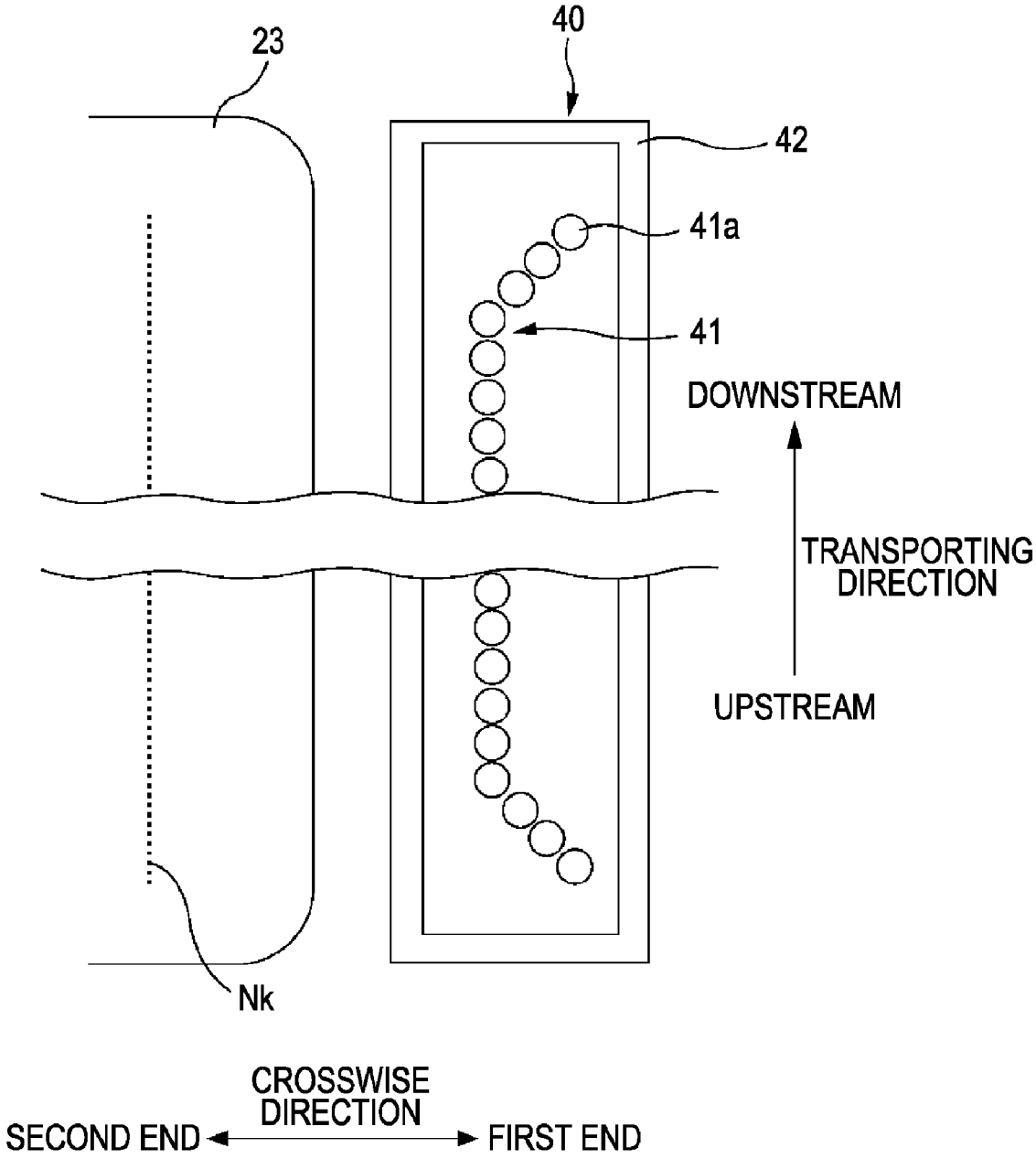
FIG. 4 illustrates a light source 41.

The light source 41 will now be described with reference to FIG. 4. FIG. 4 is a bottom view of the light source 41 of the light-emitting unit 40 according to this embodiment. In FIG. 4, the transporting direction and the crosswise direction are indicated by respective arrows. Furthermore, of the four nozzle arrays formed on the nozzle face, the nozzle array Nk located closest to the first end (i.e., closest to the light-emitting unit 40) is shown in FIG. 4 in order to show the positional relationship between the dot groups and the light source 41. In FIG. 4, the dimensional ratio between the nozzles and the UV-light-emitting elements 41*a* is different from the actual dimensional ratio in order to provide an easier understanding of the drawing.

As mentioned above, the light source 41 is constituted by the plurality of UV-light-emitting elements 41*a*. The ultraviolet light emitted from the UV-light-emitting elements 41*a* has directivity, meaning that the light-emitting unit 40 according to this embodiment emits ultraviolet light vertically downward from the UV-light-emitting elements 41*a*. The UV-light-emitting elements 41*a* emit ultraviolet light at the same output level. Consequently, in the light-emitting unit 40 according to this embodiment, the emission intensity of ultraviolet light emitted from various sections of the light source 41 is substantially the same between these sections. In this case, the "emission intensity" refers to a flux of ultraviolet light per unit solid angle when the ultraviolet light is emitted from the light-emitting unit 40. The higher the emission intensity, the higher the energy of ultraviolet light emitted to a unit area.

The light source 41 is disposed within the accommodation box 42, as shown in FIG. 4. In detail, as shown in FIG. 4, the UV-light-emitting elements 41*a* are arranged substantially at equal intervals. Moreover, an upstream end of the light source 41 in the transporting direction (specifically, the upstream-most UV-light-emitting element 41*a*) is substantially aligned with the upstream-most nozzle. Likewise, a downstream end of the light source 41 (specifically, the downstream-most UV-light-emitting element 41*a*) is substantially aligned with the downstream-most nozzle. In consequence, when the carriage 21 moves, the nozzle arrays for the respective ink colors eject UV ink droplets to form dot groups on the medium P, and the light source 41 subsequently passes directly above the dot groups formed on the medium P.

As the light source 41 passes directly above each dot group formed on the medium P, the various sections (UV-light-emitting elements 41*a*) of the light source 41 are made to face corresponding dots of the dot group. In this case, the dots that correspond to each section of the light source 41 are dots that are to receive ultraviolet light emitted from this section. In other words, each of the dots in the dot group faces the section of the light source 41 that corresponds to that dot.

In detail, a midsection of the light source 41 in the transporting direction (i.e., UV-light-emitting elements 41*a* located in the midsection in the transporting direction) is made to face a midsection of each dot group in the transporting direction (i.e., dots located in the midsection in the transporting direction). Likewise, an upstream-end section of the light source 41 in the transporting direction (i.e., UV-light-emitting elements 41*a* located in the upstream-end section in the transporting direction) is made to face an upstream end of each dot group in the transporting direction (i.e., dots located near the upstream end in the transporting direction), and a downstream-end section of the light source 41 in the transporting direction (i.e., UV-light-emitting elements 41*a* located in the downstream-end section in the transporting direction) is made to face a downstream end of each dot group in the transporting direction (i.e., dots located near the downstream end in the transporting direction). A phrase "a certain section of the light source 41 faces corresponding dots" means that the certain section is located at a position where the corresponding dots are to be exposed to ultraviolet light emitted from the certain section.

As shown in FIG. 4, in this embodiment, the UV-light-emitting elements 41*a* are arranged in an arch-like pattern. In detail, the UV-light-emitting elements 41*a* located in the aforementioned midsection of the light source 41 are arranged in the transporting direction. On the other hand, the UV-light-emitting elements 41*a* located in the upstream and downstream end sections of the light source 41 are arranged at an angle with respect to the transporting direction, such that UV-light-emitting elements 41*a* that are farther away from the midsection of the light source 41 are disposed closer towards the first end in the crosswise direction. Specifically, the distance between the UV-light-emitting elements 41*a* in the two end sections of the light source 41 and the nozzles (i.e., the nozzles located closest to the UV-light-emitting elements 41*a*) is greater than the distance between the UV-light-emitting elements 41*a* in the midsection of the light source 41 and the nozzles. In other words, a section of the light source 41 that is made to face a first end (upstream end) of a dot group and a section of the light source 41 that is made to face a second end (downstream end) of the dot group are located opposite the nozzle arrays, in the crosswise direction, relative to a section of the light source 41 that is made to face a midsection of the dot group.

Consequently, as the head 23 and the light-emitting unit 40 move from the first end towards the second end in the crosswise direction along with the movement of the carriage 21, the light source 41 faces the two ends of a dot group at a timing later than a timing at which the light source 41 faces the midsection of the dot group. As mentioned above, in the light-emitting unit 40 according to this embodiment, the emission intensity of ultraviolet light emitted from the various sections of the light source 41 is substantially the same between these sections. Therefore, when the light-emitting unit 40 emits ultraviolet light towards a dot group, the emission intensity of ultraviolet light emitted towards the midsection of the dot group and the emission intensity of ultraviolet light emitted towards the ends of the dot group are substantially the same.

Printing Process

Figure 5:
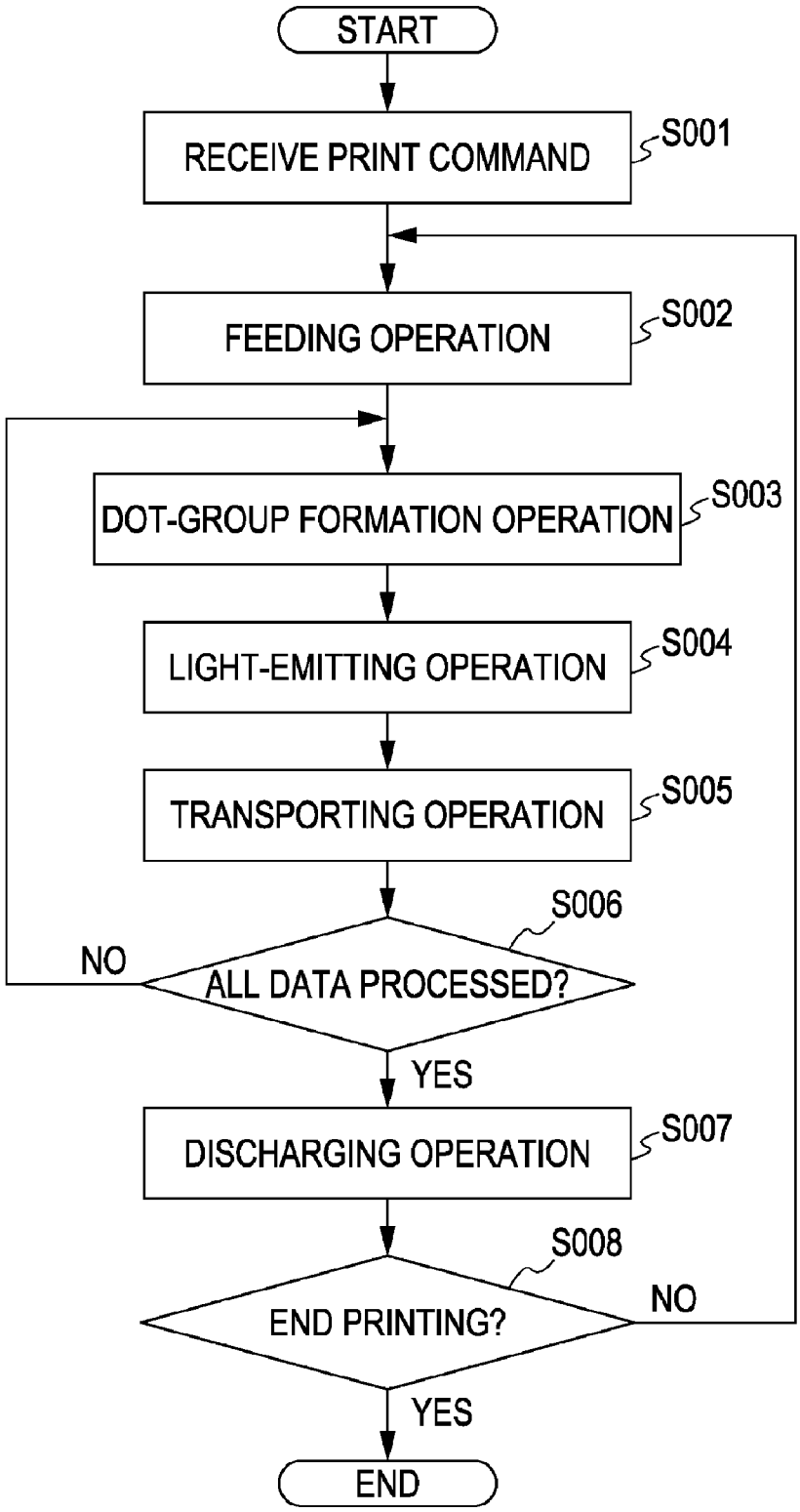
FIG. 5 is a flow chart of a printing process.

A printing process performed by the aforementioned printer 10 will now be described with reference to FIG. 5 and FIGS. 6A to 6D. FIG. 5 is a flow chart of the printing process. FIGS. 6A to 6D illustrate the dot-group formation operation. In FIGS. 6A to 6D, the transporting direction and the crosswise direction are indicated by respective arrows. To provide an easier understanding of the drawings, FIGS. 6A to 6D show dot groups of one color only, and the number of dots shown is smaller than the actual number. An alphanumeric character or characters in each dot indicate which dot-group formation operation the dot is formed in.

Referring to FIG. 5, the printing process commences when the controller 60 receives print data containing a print command from the computer 110 via an interface 61 in step S001. The controller 60 analyzes the content of various commands contained in the received print data and controls the individual units in the printer 10. In step S002, the controller 60 performs a feeding operation by causing the feeding roller 31 to feed the medium P into the printer 10 and then causing the transporting roller 33 to position the medium P at a printing start position.

Figure 6A:
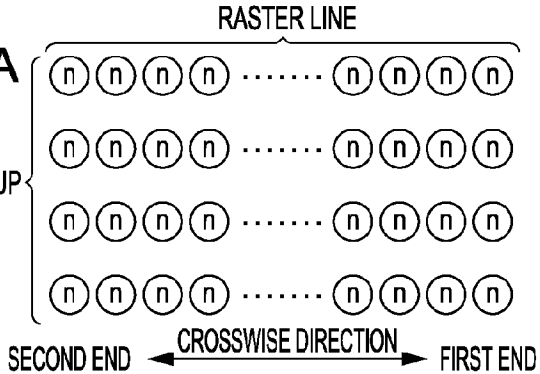
FIGS. 6A to 6D illustrate a dot-group formation operation.

In step S003, the controller 60 performs a dot-group formation operation by causing ink to be ejected from the nozzle arrays for the respective ink colors provided on the nozzle face of the head 23 so as to form a dot group extending parallel to the transporting direction on the medium P. In this case, the controller 60 moves the carriage 21 from the first end towards the second end in the crosswise direction so as to cause the nozzle arrays for the respective ink colors to intermittently eject ink while moving in the same direction as the traveling direction of the carriage 21. Consequently, as shown in FIG. 6A, a plurality of dot groups are formed on the medium P such that they are arranged at the same position in the transporting direction. In other words, a dot-group formation operation is performed for forming a dot row, i.e., a raster line, extending in the crosswise direction in a plurality (corresponding to the number of nozzles in each nozzle array) so that the dot rows are arranged in the transporting direction.

In step S004, while moving the carriage 21 from the first end to the second end of the crosswise direction, the controller 60 performs a light-emitting operation by causing the light-emitting unit 40 disposed adjacent to the trailing end of the head 23 to emit ultraviolet light toward the dot groups so as to cure the dot groups. Accordingly, in this embodiment, during each movement of the carriage 21 (specifically, each movement from the first end towards the second end in the crosswise direction), the controller 60 performs both the dot-group formation operation and the light-emitting operation for emitting ultraviolet light toward the dot groups formed as the result of the dot-group formation operation. Shortly after a dot group is formed on the medium P, the light source 41 of the light-emitting unit 40 is made to face the dot group so as to emit ultraviolet light towards the dot group. In consequence, by the time the carriage 21 reaches the second end of the movable range thereof in the crosswise direction, a plurality of dot groups are arranged in the crosswise direction and are cured as the result of being exposed to the ultraviolet light.

As mentioned above, during the light-emitting operation, that is, when the light source 41 faces each dot group, the light source 41 is made to face the two ends of the dot group at a timing later than a timing at which the light source 41 faces the midsection of the dot group. In other words, during the light-emitting operation, the two ends of the dot group are exposed to ultraviolet light emitted from the light-emitting unit 40 at a timing later than a timing at which the midsection of the dot group is exposed to the ultraviolet light emitted from the light-emitting unit 40. Therefore, the curing time of the dots (i.e., the time that takes the dots to be cured after they are formed) is longer at the two ends of the dot group than at the midsection of the dot group. In other words, the dots located at the two ends of the dot group are wetted and spread out before they are cured so as to have a thickness smaller than that of the dots located in the midsection.

In step S005, the controller 60 performs a transporting operation using the transporting unit 30 so that the medium P is transported by a predetermined distance in the transporting direction. As a result, new dot groups can be formed in a subsequent dot-group formation operation at a position, in the transporting direction, different from the position of the dot groups formed in the previous dot-group formation operation. As long as there is still print data remaining to be printed on the medium P (NO in step S006) the controller 60 alternately and repetitively performs the transporting operation and the dot-group formation operation. In consequence, a plurality of dot groups extending in the transporting direction are formed on the medium P. The controller 60 performs the light-emitting operation every time it performs the dot-group formation operation.

Figure 6B:
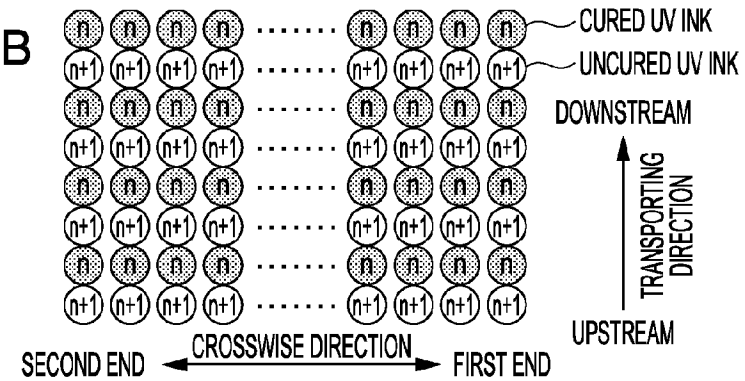

The dot-group formation operation according to this embodiment will be described in further detail with reference to FIGS. 6A to 6D. This embodiment employs a printing method in which raster lines are complementarily formed by performing the dot-group formation operation multiple times (each dot-group formation operation will be referred to as "pass" hereinafter). For example, as shown in FIGS. 6A and 6B, after a pass n, the medium P is transported downstream in the transporting direction by a predetermined distance. In a pass (i.e., a pass (n+1)) subsequent to the pass n, dot groups are formed such that raster lines formed in the pass (n+1) are partly positioned between the raster lines formed in the pass n. In this case, when the dot groups are to be formed in the pass (n+1), the dot groups formed in the pass n are already cured as the result of the light-emitting operation performed simultaneously with the pass n.

Figure 6C:
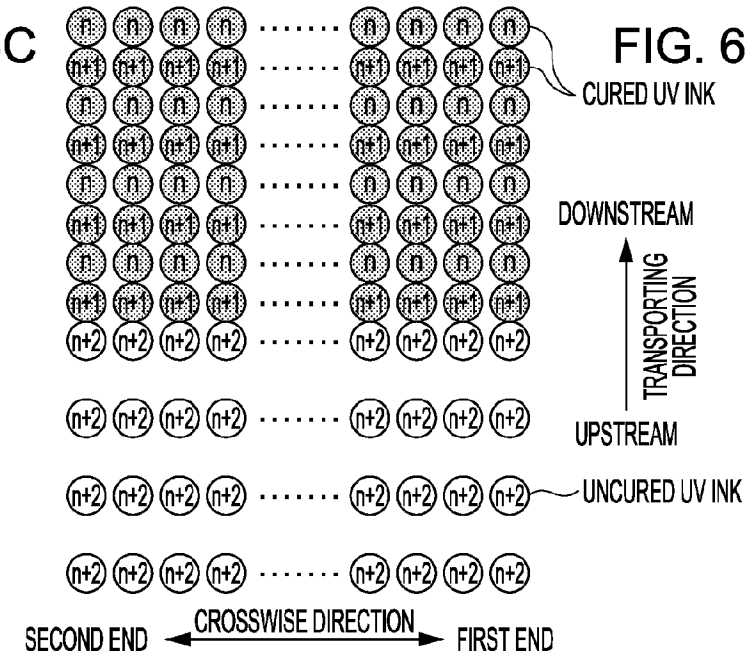
Figure 6D:
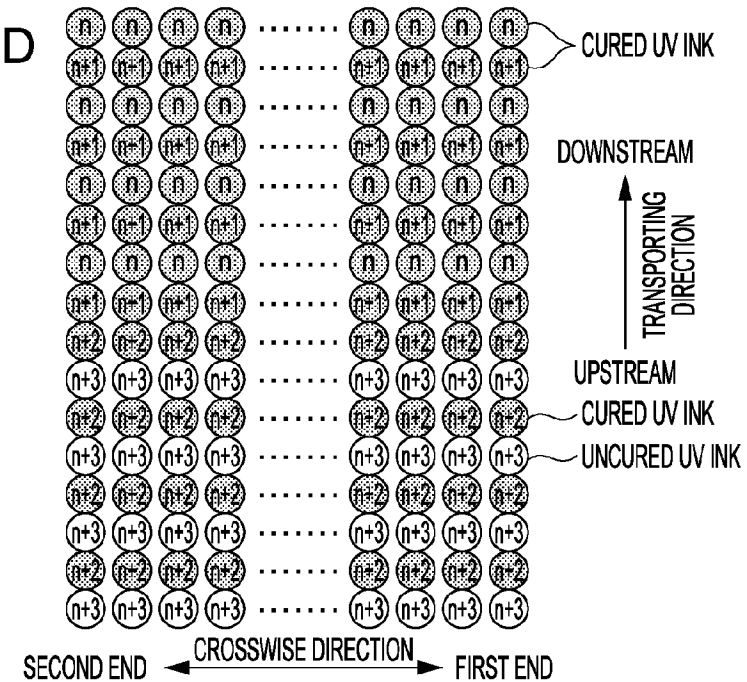

Before proceeding to a pass (n+2), the medium P is transported downstream in the transporting direction by a predetermined distance. Referring to FIG. 6C, dot groups are formed in the pass (n+2) such that the upstream-most raster line formed in the pass (n+1) and the downstream-most raster line formed in the pass (n+2) are adjacent to each other in the transporting direction. In this case, when the dot groups are to be formed in the pass (n+2), the dot groups formed in the pass (n+1) are already cured. Before proceeding to a pass (n+3), the medium P is transported further downstream in the transporting direction by a predetermined distance. Referring to FIG. 6D, dot groups are formed in the pass (n+3) such that raster lines formed in the pass (n+3) are partly positioned between the raster lines formed in the pass (n+2). In this case, when the dot groups are to be formed in the pass (n+3), the dot groups formed in the pass (n+2) are already cured. Subsequently, with the same procedure as above, the transporting operation and the dot-group formation operation are alternately and repetitively performed, and the light-emitting operation is performed every time the dot-group formation operation is performed.

When there is no print data remaining to be printed on the medium P (YES in step S006), the controller 60 performs a discharging operation in step S007 to cause the discharging roller 35 to discharge the medium P outward from the printer 10. After the medium P having an image printed thereon is discharged outward from the printer 10, the controller 60 determines in step S008 whether or not to end the printing process. If printing is to be performed on a new medium P (NO in step S008), the controller 60 returns to the feeding operation so as to continue the printing process. In contrast, if no printing is to be performed on a new medium P (YES in step S008), the controller 60 ends the printing process.

Advantages of Printer 10 According to this Embodiment

The printer 10 according to this embodiment allows for a uniform thickness of UV ink landed on the medium P for printing an image thereon (i.e., a uniform thickness of UV ink that is cured after it is ejected and landed on the medium P). In consequence, the printer 10 according to this embodiment can print high-quality images.

Figure 7A:
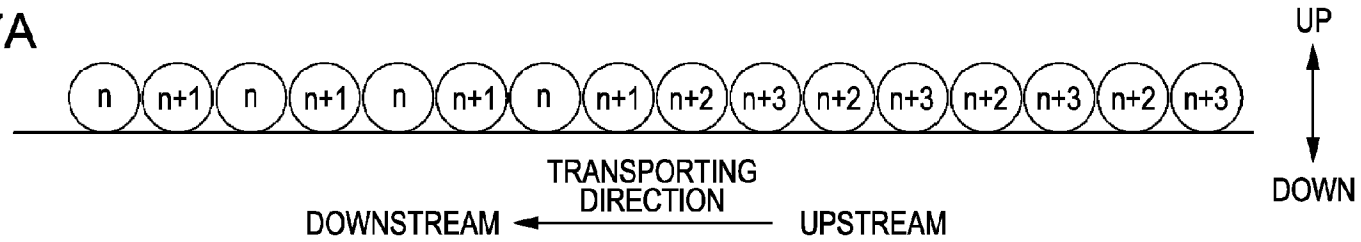
FIGS. 7A to 7C are schematic diagrams for explaining the advantages of the printer 10.
Figure 7B:
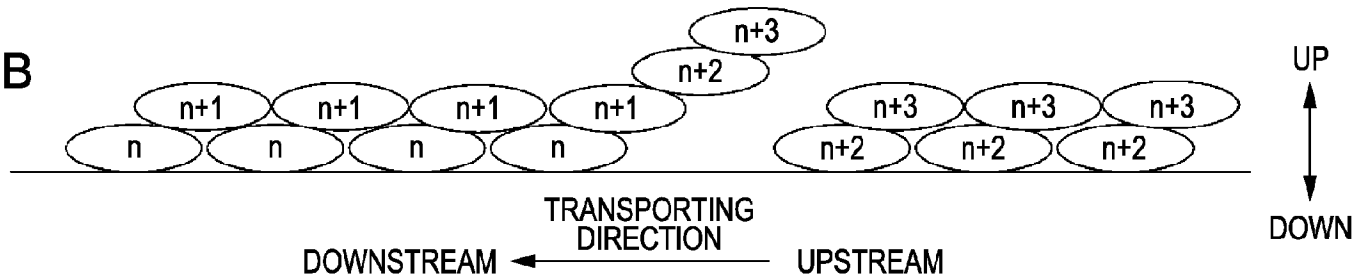
Figure 7C:
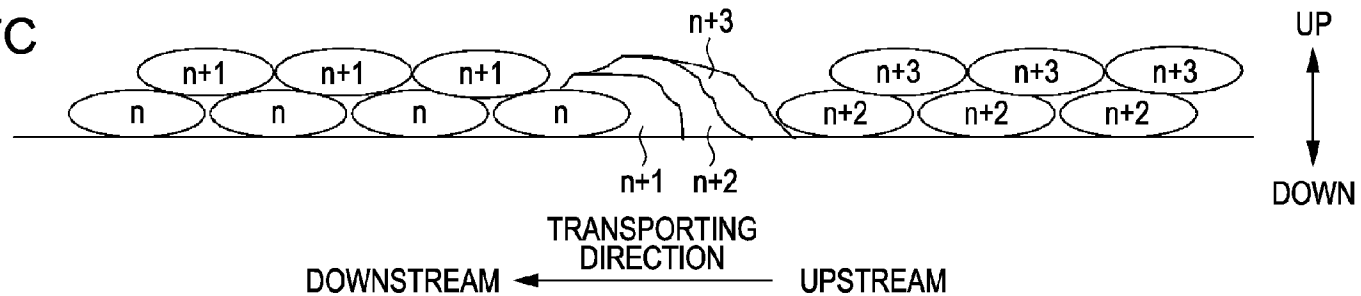

The advantages of the printer 10 according to this embodiment will be described with reference to FIGS. 7A to 7C. FIGS. 7A to 7C are schematic diagrams for explaining the advantages of the printer 10. Specifically, FIG. 7A illustrates a plurality of ideally formed dot groups. FIG. 7B illustrates a plurality of dot groups formed by a printer of the related art. FIG. 7C illustrates a plurality of dot groups formed by the printer 10 according to this embodiment. In FIGS. 7A to 7C, the thickness direction (i.e., the up-down direction) of the medium P and the transporting direction are indicated by respective arrows. Furthermore, in FIGS. 7A to 7C, an alphanumeric character or characters in each dot indicate which dot-group formation operation the dot is formed in.

As described above in the related art, the thickness of UV ink landed and cured on the medium P is preferably uniform in the direction in which the dots are arranged in each dot group, namely, the transporting direction. With the aforementioned printing process (i.e., when a plurality of dot groups are formed as shown in FIGS. 6A to 6D) as an example, when the UV ink lands on the surface of the medium P in each pass to form dots on the surface as shown in FIG. 7A (that is, when the dot groups are formed on the medium P without overlapping each other), the thickness is uniform in the transporting direction so long as the amount of ink ejected from the individual nozzles is the same.

After landing on the medium P, the UV ink is wetted and spread out before it is cured. Specifically, the dots formed by the UV ink are wetted and spread out so as to be reduced in thickness until they are cured by receiving ultraviolet light. Since the dots are cured in such a spread state, the distance between the dots becomes smaller. As a result, as shown in FIG. 7B, after a dot group formed in a certain pass (such as the pass n) is cured, the UV ink may sometimes land on the cured dot group during a pass (such as the pass (n+1)) subsequent to the certain pass. In other words, a dot group formed in a pass can sometimes partly overlap an already cured dot group formed in the previous pass. Needless to say, the overlapping region of the two dot groups are increased in thickness, and the thickness increases with increasing number of overlapping dot groups.

In the printer of the related art, an end of each dot group in the transporting direction tends to become thicker than the midsection of the dot group. This can possibly result in a non-uniform thickness. The reason for the end of each dot group being thicker than the midsection of the dot group in the printer of the related art will be described below with reference to FIG. 7B.

As described above, in the aforementioned printing process, after a dot group formed in the pass n is cured, the UV ink lands on the cured dots during the pass (n+1). In other words, in the pass (n+1), a dot group is formed such that the dots partly overlap the dots formed in the pass n. With regard to the dot group formed in the pass n, each of the dots located in the midsection of the dot group is flanked by dots formed in the same pass (i.e., the pass n), and is also overlapped by the dots formed in the pass (n+1), as shown in FIG. 7B. Specifically, when the pass (n+1) is completed, a region of the medium P that corresponds to the midsection of the dot group formed in the pass n has a combination of dots formed in the pass n and dots formed in the pass (n+1).

On one side (upstream side) of a dot located at the upstream end of the dot group formed in the pass n, there are no dots formed in the same pass (i.e., the pass n). On the other hand, this dot located at the upstream end of the dot group formed in the pass n is overlapped by a dot formed in the pass (n+1). Specifically, as shown in FIG. 7B, in a region of the medium P that is located further upstream of the upstream end of the dot group formed in the pass n, there are no dots formed in the pass n or the pass (n+1).

In a pass (i.e., the pass (n+2)) subsequent to the pass (n+1), a dot (at an end of a dot group) is formed in the region of the medium P that is located adjacent to the upstream end of the dot group formed in the pass n. Since the dots in the dot group formed in the pass (n+1) are also wetted and spread out before they are cured, a dot located at the upstream end of the dot group formed in the pass (n+1) is overlapped by a dot located at the downstream end of the dot group formed in the pass (n+2), as shown in FIG. 7B.

Since the dots in the dot group formed in the pass (n+2) are also wetted and spread out before they are cured, a dot group is formed in the pass (n+3) such that the dots partly overlap the dot group formed in the pass (n+2), as shown in FIG. 7B. As a result, the dot located at the upstream end of the dot group formed in the pass n is overlapped by a dot formed in the pass (n+1), a dot formed in the pass (n+2), and a dot formed in the pass (n+3).

As described above, each of the dots located in the midsection of a dot group formed in each pass is flanked by dots formed in the same pass. On the other hand, on one side (i.e., the outer side of the dot group) of a dot located at an end of the dot group, there are no dots formed in the same pass. Therefore, the dot located at the end of the dot group is readily overlapped by a dot formed in a different pass. In other words, an end of an already cured dot group formed in a certain pass is overlapped by a larger number of dot groups formed in passes different from that certain pass, as compared with the midsection of the already cured dot group.

On the other hand, during the light-emitting operation in the printer of the related art, the light-emitting unit emits ultraviolet light towards both the midsection and the ends of each dot group at the same time and with the same emission intensity. In that case, the dots located at the ends of the dot group and the dots located at the midsection of the dot group are cured at the same time. Therefore, an end of the dot group, which is overlapped by a larger number of dot groups formed in different passes, becomes thicker than the midsection of the dot group, as shown in FIG. 7B. As the result of the end of the dot group having a larger thickness, so-called banding occurs in an area of a finally obtained image that corresponds to the end of the dot group, thus reducing the quality of the image.

In contrast, during the light-emitting operation in this embodiment, the two ends of each dot group are exposed to ultraviolet light emitted from the light-emitting unit 40 at a timing later than a timing at which the midsection of the dot group is exposed to the ultraviolet light emitted from the light-emitting unit 40. Therefore, the curing time of the dots is longer at the two ends of the dot group than at the midsection of the dot group. In other words, the dots located at the two ends of the dot group are wetted and spread out before they are cured so as to have a thickness smaller than that of the dots located in the midsection. In consequence, dots formed in different passes and overlapping the dot located at the end of the dot group can be reduced in thickness. As a result, the midsection of the dot group and the end of the dot group can substantially have the same thickness, as shown in FIG. 7C.

Accordingly, the thickness of UV ink landed on the medium P can be made uniform in the transporting direction. With the uniform thickness, the occurrence of banding in an image, which may be caused when the midsection of a dot group and the ends of the dot group have different thicknesses, can be reduced, thereby enhancing the quality of the image.

Furthermore, during the light-emitting operation in this embodiment, the light source 41 of the light-emitting unit 40 is made to face the two ends of each dot group at a timing later than a timing at which the light source 41 faces the midsection of the dot group. Thus, during the light-emitting operation, the two ends of the dot group can be readily exposed to ultraviolet light emitted from the light-emitting unit 40 at a timing later than a timing at which the midsection of the dot group is exposed to the ultraviolet light emitted from the light-emitting unit 40. Although the two ends of the dot group can be exposed to ultraviolet light emitted from the light-emitting unit 40 at a timing later than a timing at which the midsection of the dot group is exposed to the ultraviolet light emitted from the light-emitting unit 40 by, for example, adjusting the lighting timing of the individual UV-light-emitting elements 41*a*, the technique employed in this embodiment can be more easily achieved.

Furthermore, according to this embodiment, the sections of the light source 41 that are made to face the two ends of each dot group are located opposite the nozzle arrays, in the crosswise direction, relative to the section of the light source 41 that is made to face the midsection of the dot group. This configuration further facilitates the emission of ultraviolet light towards the two ends of the dot group at a timing later than a timing of the emission of the ultraviolet light towards the midsection of the dot group during the light-emitting operation performed by the light-emitting unit 40. Although the two ends of the dot group can be exposed to ultraviolet light emitted from the light-emitting unit 40 at a timing later than a timing at which the midsection of the dot group is exposed to the ultraviolet light emitted from the light-emitting unit 40 by, for example, moving the light source 41 so that it faces the ends of the dot group after facing the midsection of the dot group, the technique employed in this embodiment can be more easily achieved.

Figure 8:
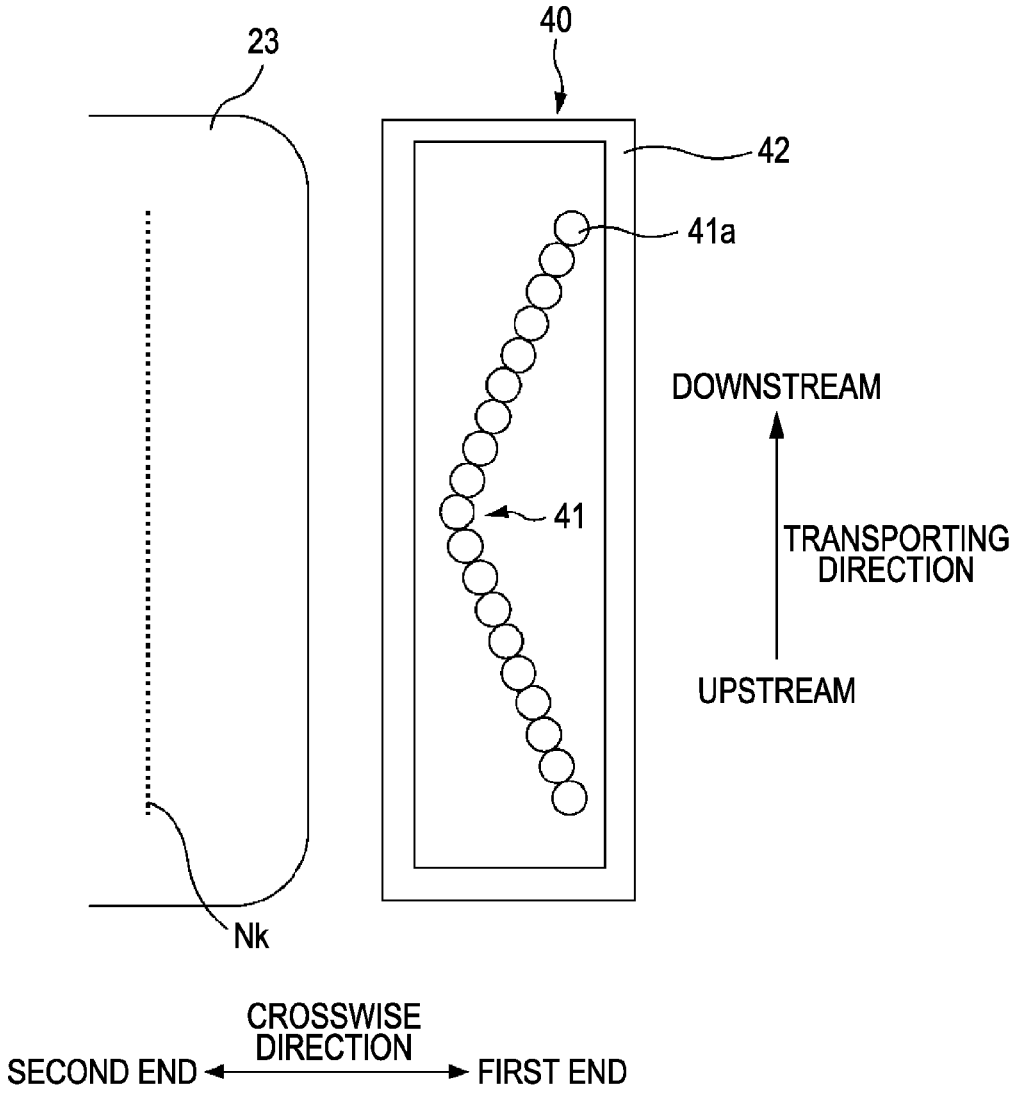
FIG. 8 illustrates a modification related to an arrangement of a plurality of UV-light-emitting elements 41*a*.

As described above, in this embodiment, the UV-light-emitting elements 41*a* are arranged as shown in FIG. 4 so that the sections of the light source 41 that are made to face the two ends of each dot group are located opposite the nozzle arrays, in the crosswise direction, relative to the section of the light source 41 that is made to face the midsection of the dot group. However, an alternative arrangement is also possible for the UV-light-emitting elements 41*a*. For example, referring to FIG. 8, the UV-light-emitting elements 41*a* may be arranged to form a sideways V-shape pattern. With such an arrangement, the sections of the light source 41 made to face the two ends of each dot group can still be located opposite the nozzle arrays relative to the section of the light source 41 made to face the midsection of the dot group. FIG. 8 illustrates a modification related to the arrangement of the UV-light-emitting elements 41*a*.

Figure 9:
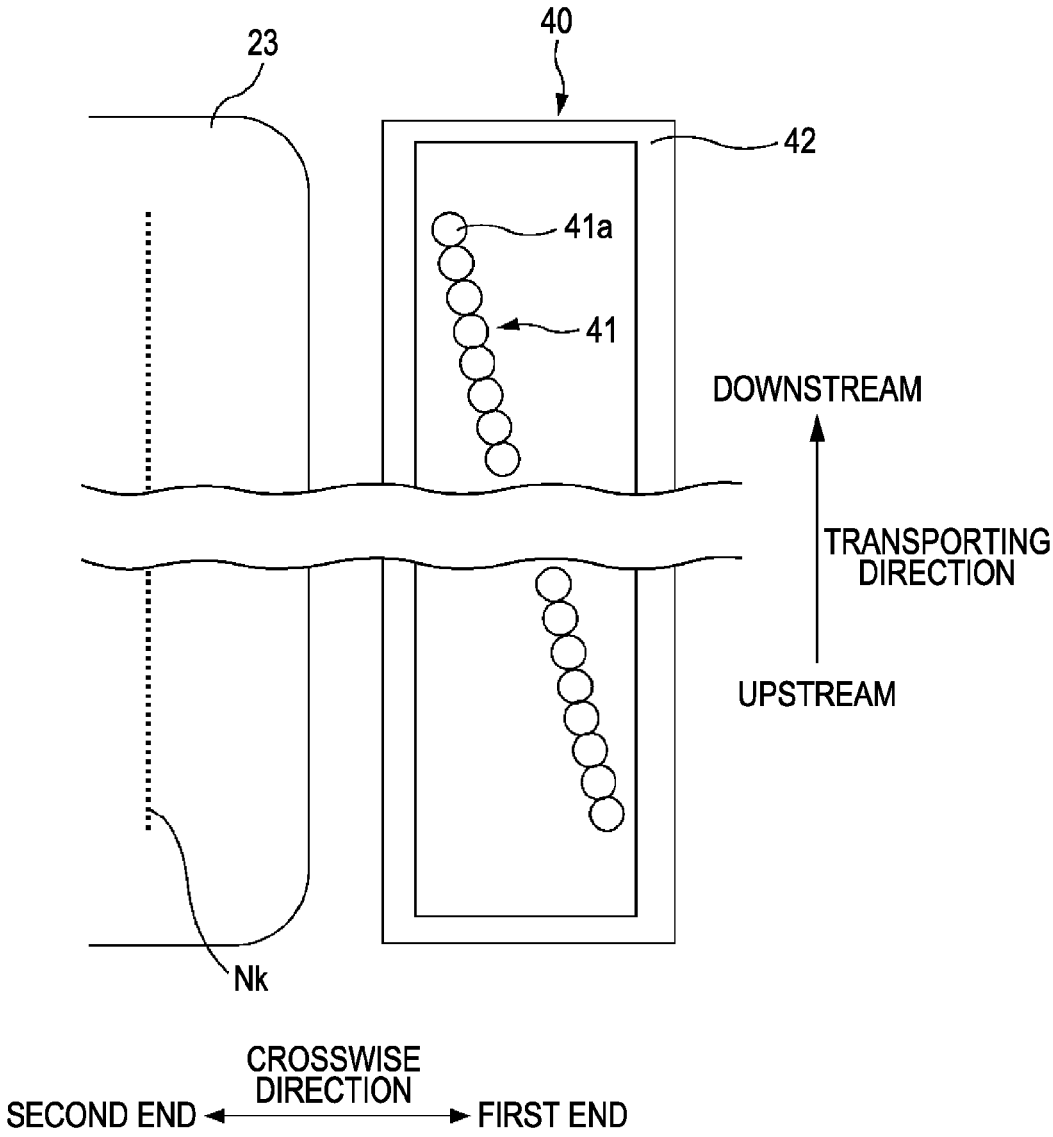
FIG. 9 illustrates a second modification related to the arrangement of the UV-light-emitting elements 41*a*.
Figure 10:
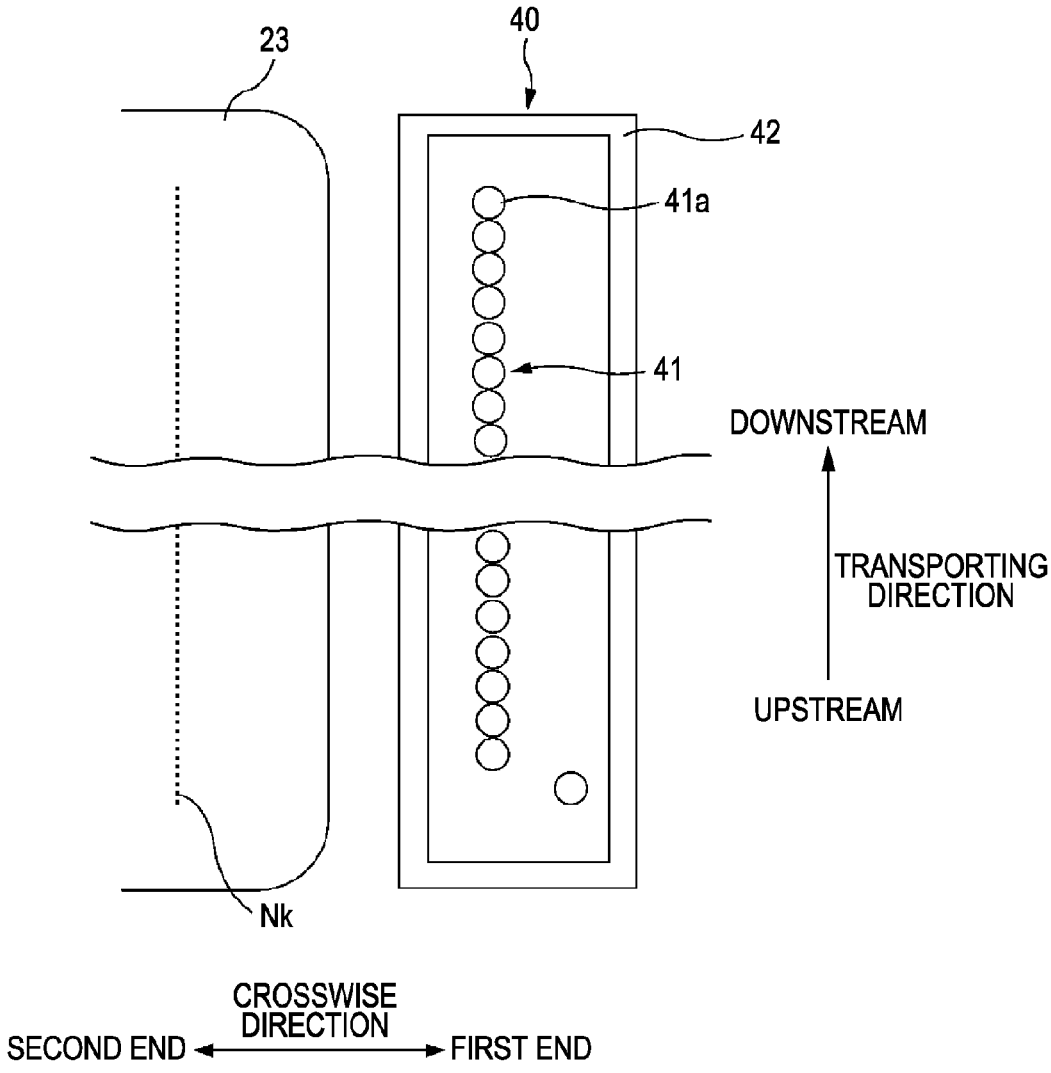
FIG. 10 illustrates a third modification related to the arrangement of the UV-light-emitting elements 41*a*.

As a further alternative, only the section of the light source 41 made to face the upstream (or downstream) end of each dot group may be located opposite the nozzle arrays, in the crosswise direction, relative to the section of the light source 41 made to face the midsection of the dot group. For example, referring to FIG. 9, the UV-light-emitting elements 41*a* may be arranged to form an array that is inclined with respect to the transporting direction. In other words, a linear light source 41 that is inclined with respect to the transporting direction may be provided. As another alternative, referring to FIG. 10, the UV-light-emitting elements 41*a* excluding the upstream-most (or downstream-most) UV-light-emitting element 41*a* may be arranged in an array extending in the transporting direction, and the remaining upstream-most (or downstream-most) UV-light-emitting element 41*a* may be deviated from the array so as to be located opposite the nozzle arrays. FIGS. 9 and 10 illustrate modifications related to the arrangement of the UV-light-emitting elements 41*a*.

Accordingly, the aforementioned advantages can be achieved so long as a section of the light source 41 made to face at least one of the two ends of each dot group is located opposite the nozzle arrays relative to the section of the light source 41 made to face the midsection of the dot group. This means that the curing time of the dots is longer in the at least one end of the dot group than at the midsection of the dot group. In consequence, the thickness of the at least one end of the dot group can be made substantially equal to the thickness of the midsection of the dot group.

On the other hand, when the sections of the light source 41 made to face the two ends of each dot group are located opposite the nozzle arrays relative to the section of the light source 41 made to face the midsection of the dot group, as in this embodiment, the curing time of the dots is longer at the two ends of the dot group than at the midsection of the dot group. With this configuration, the thickness can appropriately be made uniform even when the number of dot groups overlapping an end of the dot group increases.

Other Embodiments

Although the embodiment described above is directed to the printer 10 as an example of a liquid ejecting apparatus according to an embodiment of the invention and to the printing method as an example of a liquid ejecting method according to an embodiment of the invention, the above-described embodiment of the invention is only intended to provide an easier understanding of the invention but not to limit the invention. Various modifications and changes are permissible so long as they do not depart from the scope of the invention, and equivalents thereof are included in the invention.

During the light-emitting operation in the above embodiment, at least one of the two ends of each dot group is exposed to ultraviolet light emitted from the light-emitting unit 40 at a timing later than a timing at which the midsection of the dot group is exposed to the ultraviolet light emitted from the light-emitting unit 40. Therefore, the curing time of the dots is longer at the at least one end of the dot group than at the midsection of the dot group, whereby the thickness of UV ink landed on the medium P can be made uniform in the transporting direction. As an alternative to the above embodiment, the following example (referred to as "alternative example" hereinafter) can also be applied for giving the UV ink landed on the medium P a uniform thickness in the transporting direction. The alternative example will be described in detail below.

In the alternative example, the light source 41 is constituted by a plurality of UV-light-emitting elements 41*a* that are arranged in an array extending in the transporting direction. Specifically, during the light-emitting operation in the alternative example, the light source 41 is made to face both the two ends of each dot group and the midsection of the dot group substantially at the same time. On the other hand, during the light-emitting operation, the emission intensity of ultraviolet light emitted towards at least one of the two ends of the dot group from the light-emitting unit 40 according to the alternative example is lower than the emission intensity of ultraviolet light emitted towards the midsection of the dot group from the light-emitting unit 40.

The lower the emission intensity of ultraviolet light (in other words, the lower the energy of ultraviolet light emitted), the longer it takes the UV ink receiving the ultraviolet light to be cured. Therefore, although the light-emitting unit 40 emits ultraviolet light towards both the two ends of each dot group and the midsection of the dot group substantially at the same time in the alternative example, the curing time of the dots at the at least one end of the dot group is longer than the curing time at the midsection of the dot group. As a result, the thickness of UV ink landed on the medium P can be made uniform in the transporting direction, as in the above embodiment.

As described above, during the light-emitting operation, the emission intensity of ultraviolet light emitted towards at least one of the two ends of the dot group from the light-emitting unit 40 is lower than the emission intensity of ultraviolet light emitted towards the midsection of the dot group from the light-emitting unit 40. This can be achieved by, for example, setting the output from the section of the light source 41 made to face the at least one end of the dot group (i.e., the UV-light-emitting element 41*a* corresponding to the at least one end) to a level lower than that of the output from the section of the light source 41 made to face the midsection of the dot group (i.e., the UV-light-emitting elements 41*a* corresponding to the midsection of the dot group), or by setting the distance between the at least one end of the dot group and the light source 41, in the up-down direction, greater than the distance between the midsection of the dot group and the light source 41.

Figure 11:
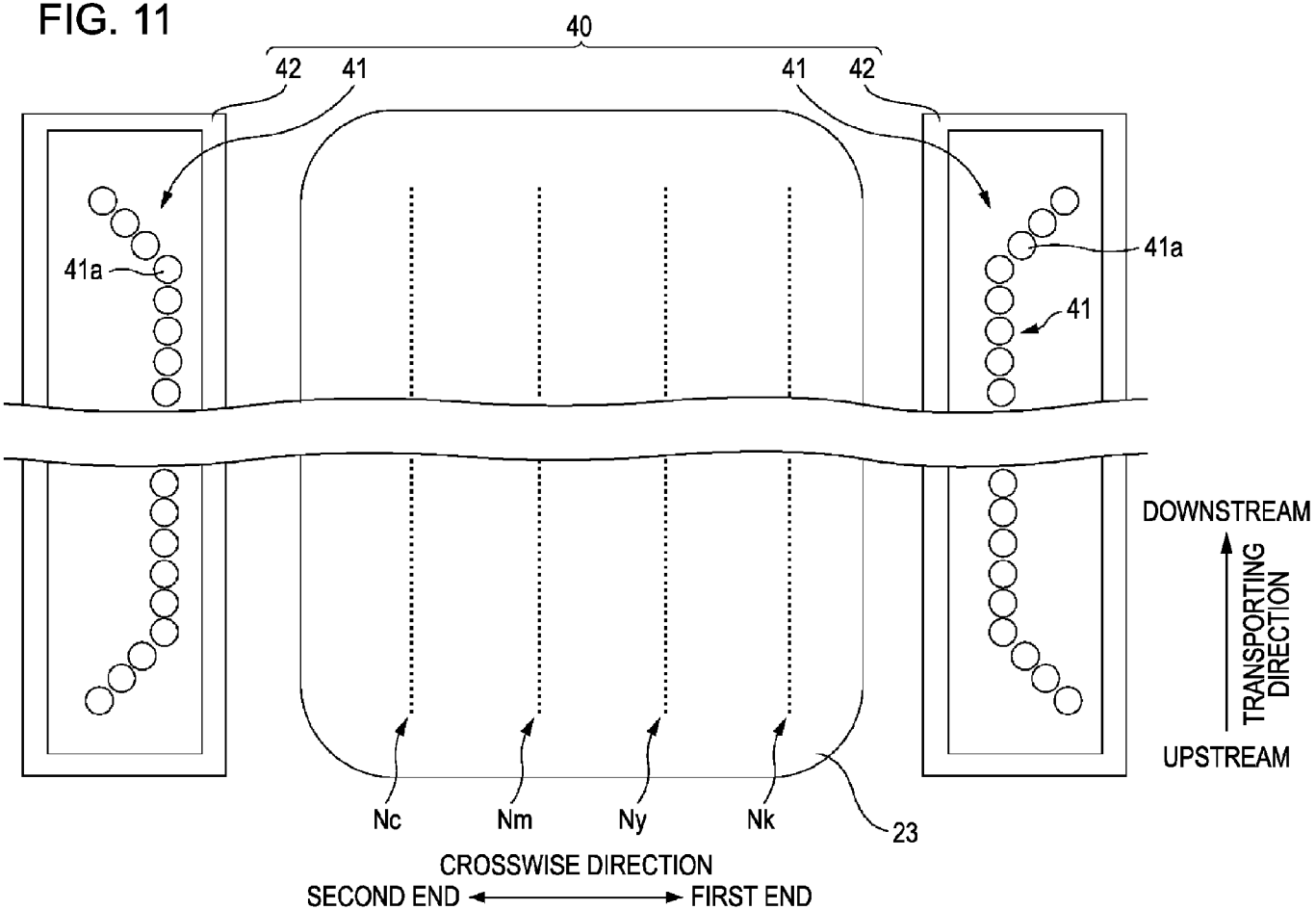
FIG. 11 illustrates a light-emitting unit 40 provided with two light sources 41 at the opposite sides of a head 23.

In the above embodiment, the head 23 is configured to eject ink while moving from the first end to the second end in the crosswise direction, but is configured not to eject ink when moving from the second end to the first end. In addition, a single light source 41 is provided adjacent to the first end of the head 23 in the crosswise direction. Alternatively, the head 23 may be configured to eject ink when moving from the first end to the second end in the crosswise direction as well as when moving from the second end to the first end. In that case, referring to FIG. 11, it is preferable that two light sources 41 are respectively provided at the opposite sides of the head 23 in the crosswise direction (namely, the light-emitting unit 40 may be provided with two light sources 41). FIG. 11 illustrates the light-emitting unit 40 provided with two light sources 41 at the opposite sides of the head 23.

As shown in FIG. 11, the two light sources 41 are bilaterally symmetrical with respect to an imaginary line extending through the middle of the head 23. In detail, of the plurality of UV-light-emitting elements 41*a* provided in each light source 41, the UV-light-emitting elements 41*a* corresponding to at least one of the two ends of each dot group (i.e., the UV-light-emitting elements 41*a* corresponding to the two ends in the example shown in FIG. 11) are located opposite the nozzle arrays relative to the UV-light-emitting elements 41*a* corresponding to the midsection of the dot group. Furthermore, when the head 23 ejects UV ink from the nozzles thereof while moving in the crosswise direction, the light-emitting unit 40 emits ultraviolet light from the light source 41 located behind the head 23 as viewed in the traveling direction of the head 23, but does not emit ultraviolet light from the light source 41 located in front of the head 23. As a result, during the light-emitting operation, at least one of the two ends of each dot group can be exposed to ultraviolet light emitted from the light-emitting unit 40 at a timing later than a timing at which the midsection of the dot group is exposed to the ultraviolet light emitted from the light-emitting unit 40, whereby advantages similar to those in the above embodiment can be achieved.

Although the embodiment described above is directed to the printer 10 (i.e., a so-called serial printer) having the head 23 that moves in the crosswise direction for forming raster lines, the invention is not limited to a printer of this type. For example, the invention is also applicable to a printer (i.e., a so-called line printer) having a stationary head 23 disposed at a fixed position and capable of simultaneously forming a plurality of dots arranged in the crosswise direction.

Furthermore, although the medium P is relatively moved with respect to the nozzle arrays for the respective ink colors by transporting the medium P in the transporting direction during the transporting operation in the above embodiment, the invention is not limited to this. For example, by alternately and repetitively performing a moving operation of moving the head 23 (that is, the nozzle arrays) in a direction corresponding to the transporting direction (i.e., the extending direction of the nozzle arrays) while keeping the medium P at a fixed position and a dot-group formation operation, a plurality of dot groups can be formed in the direction corresponding to the transporting direction.

The above embodiment employs a printing method in which raster lines are complementarily formed by performing the dot-group formation operation (pass) multiple times. However, regardless of the type of printing method employed, an end of an already-cured dot group formed in a certain pass is overlapped by a larger number of dot groups formed in passes different from that certain pass, as compared with the midsection of the already-cured dot group. Therefore, even if other printing methods are employed, the above embodiment of the invention still allows for a uniform thickness of UV ink landed on the medium P in the transporting direction. For example, as an alternative printing method to the printing method employed in the above embodiment, the medium P may be transported, after a dot-group formation operation, by a distance equivalent to the length of the head 23 in the transporting direction before proceeding to a subsequent dot-group formation operation, or a single raster line may be formed using different nozzles.

Although the embodiment described above is directed to the printer 10 that ejects UV ink as an example of a liquid, the liquid may be of any kind so long as it can be cured by receiving ultraviolet light. The invention can be applied to a liquid ejecting apparatus that ejects a liquid other than UV ink (including a liquid containing dispersed particles of, for example, functional materials). Examples of such a liquid ejecting apparatus include a liquid ejecting apparatus that ejects a liquid containing an electrode material or a colorant in a dispersed or dissolved state used for manufacturing liquid crystal displays, electroluminescence (EL) displays, and field emission displays, a liquid ejecting apparatus that ejects a liquid containing a bioorganic compound used for manufacturing biochips, a liquid ejecting apparatus that ejects a liquid to form a sample used as a precision pipette, a liquid ejecting apparatus that ejects a transparent resin liquid, such as ultraviolet curable resin, onto a substrate to form a micro hemispherical lens (optical lens) used in an optical communication device or the like, and a liquid ejecting apparatus that ejects an acidic or alkali etching solution for etching a substrate or the like. The invention can be applied to any of the liquid ejecting apparatuses of these types.

What is claimed is:

1. A liquid ejecting apparatus comprising:

a plurality of nozzles arranged in an array;

a light-emitting portion that emits ultraviolet light; and a control portion that alternately and repetitively performs a transporting operation of transporting a medium in a transporting direction relative to the nozzles and a dot-group formation operation of forming a dot group in the transporting direction on the medium by ejecting a liquid toward the medium from the nozzles so as to form the dot group in a plurality in the transporting direction while the nozzles travel in a crosswise direction, and that also performs a light-emitting operation every time the control portion performs the dot-group formation operation, the light-emitting operation being performed by causing the light-emitting portion to emit the ultraviolet light toward each dot group to cure the dot group, wherein, during the light-emitting operation, at least one of two ends of the dot group in the transporting direction is exposed to the ultraviolet light emitted from the light-emitting portion at a timing later than a timing at which a midsection of the dot group in the transporting direction is exposed to the ultraviolet light emitted from the light-emitting portion.

2. The liquid ejecting apparatus according to claim 1, wherein the light-emitting portion includes an ultraviolet light source that emits the ultraviolet light towards the dot group while facing the dot group, and wherein, during the light-emitting operation, the light source faces the at least one end of the dot group at a timing later than a timing at which the light source faces the midsection of the dot group.

3. The liquid ejecting apparatus according to claim 2, wherein, when performing the dot-group formation operation, the control portion causes the nozzles to eject the liquid towards the medium while moving the nozzles in the crosswise direction extending crosswise to the transporting direction, wherein the light source follows the nozzles in the crosswise direction when the nozzles move in the crosswise direction, and wherein a section of the light source that faces the at least one end of the dot group is located, in the crosswise direction, relative to a section of the light source that faces the midsection of the dot group.

4. The liquid ejecting apparatus according to claim 3, wherein a section of the light source that faces one end of the dot group and a section of the light source that faces another end of the dot group are both located, in the crosswise direction, relative to the section of the light source that faces the midsection of the dot group.

5. A liquid ejecting apparatus comprising:

a plurality of nozzles arranged in an array;

a light-emitting portion that emits ultraviolet light; and a control portion that alternately and repetitively performs a transporting operation of transporting a medium in a transporting direction relative to the nozzles and a dot-group formation operation of forming a dot group in the transporting direction on the medium by ejecting a liquid toward the medium from the nozzles so as to form the dot group in a plurality in the transporting direction while the nozzles travel in a crosswise direction, and that also performs a light-emitting operation every time the control portion performs the dot-group formation operation, the light-emitting operation being performed by causing the light-emitting portion to emit the ultraviolet light toward each dot group to cure the dot group, wherein, during the light-emitting operation, an emission intensity of the ultraviolet light emitted from the light-emitting portion towards at least one of two ends of the dot group in the transporting direction is lower than an emission intensity of the ultraviolet light emitted from the light-emitting portion towards a midsection of the dot group in the transporting direction.

6. A liquid ejecting method comprising:

alternately and repetitively performing a transporting operation of transporting a medium in a transporting direction relative to a plurality of nozzles and a dot-group formation operation of forming a dot group in the transporting direction on the medium by ejecting a liquid toward the medium from the nozzles so as to form the dot group in a plurality in the transporting direction while the nozzles travel in a crosswise direction; and performing a light-emitting operation of emitting ultraviolet light toward each dot group every time the dot-group formation operation is performed, wherein, during the light-emitting operation, at least one of two ends of the dot group in the transporting direction is exposed to the ultraviolet light at a timing later than a timing at which a midsection of the dot group in the transporting direction is exposed to the ultraviolet light.

7. A liquid ejecting method comprising:

alternately and repetitively performing a transporting operation of transporting a medium in a transporting direction relative to a plurality of nozzles and a dot-group formation operation of forming a dot group in the transporting direction on the medium by ejecting a liquid toward the medium from the nozzles so as to form the dot group in a plurality in the transporting direction while the nozzles travel in a crosswise direction; and performing a light-emitting operation of emitting ultraviolet light toward each dot group every time the dot-group formation operation is performed, wherein, during the light-emitting operation, an emission intensity of the ultraviolet light emitted towards at least one of two ends of the dot group in the transporting direction is lower than an emission intensity of the ultraviolet light emitted towards a midsection of the dot group in the transporting direction.

* * * * *